US011372351B2

(12) United States Patent
Miyauchi et al.

(10) Patent No.: US 11,372,351 B2
(45) Date of Patent: Jun. 28, 2022

(54) ELECTROPHOTOGRAPHIC MEMBER AND ELECTROPHOTOGRAPHIC IMAGE FORMING APPARATUS

(71) Applicant: CANON KABUSHIKI KAISHA, Tokyo (JP)

(72) Inventors: Yohei Miyauchi, Tokyo (JP); Toshio Tanaka, Kanagawa (JP); Yasutomo Tsuji, Tochigi (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 17/465,376

(22) Filed: Sep. 2, 2021

(65) Prior Publication Data

US 2022/0082963 A1 Mar. 17, 2022

(30) Foreign Application Priority Data

Sep. 14, 2020 (JP) ..... JP2020-153863
Aug. 20, 2021 (JP) ..... JP2021-134602

(51) Int. Cl.
*G03G 15/16* (2006.01)

(52) U.S. Cl.
CPC ..... *G03G 15/162* (2013.01); *G03G 15/1605* (2013.01); *G03G 15/1685* (2013.01)

(58) Field of Classification Search
CPC ..... G03G 15/1605; G03G 15/162; G03G 15/1685
See application file for complete search history.

(56) References Cited

U.S. PATENT DOCUMENTS

| | | | |
|---|---|---|---|
| 4,427,753 | A | 1/1984 | Fujimura et al. |
| 4,610,942 | A | 9/1986 | Yashiki et al. |
| 5,158,847 | A | 10/1992 | Go et al. |
| 5,227,271 | A | 7/1993 | Kikuchi et al. |
| 5,284,729 | A | 2/1994 | Tanaka et al. |
| 5,415,962 | A | 5/1995 | Kanemaru et al. |
| 5,484,673 | A | 1/1996 | Kikuchi et al. |
| 5,543,473 | A | 8/1996 | Fuei et al. |
| 5,677,095 | A | 10/1997 | Kikuchi et al. |
| 5,756,248 | A | 5/1998 | Tanaka et al. |
| 5,912,098 | A | 6/1999 | Tanaka et al. |
| 6,185,398 | B1 | 2/2001 | Tanaka et al. |
| 6,818,368 | B2 | 11/2004 | Tanaka et al. |
| 6,958,204 | B2 | 10/2005 | Tanaka et al. |
| 6,991,881 | B2 | 1/2006 | Ogaki et al. |
| 6,994,941 | B2 | 2/2006 | Tanaka et al. |

(Continued)

FOREIGN PATENT DOCUMENTS

| | | | |
|---|---|---|---|
| JP | 2014-81603 | A | 5/2014 |
| JP | 2015-125226 | A | 7/2015 |

(Continued)

OTHER PUBLICATIONS

U.S. Appl. No. 17/327,139, filed May 21, 2021, Naoko Kasai.

*Primary Examiner* — Joseph S Wong
(74) *Attorney, Agent, or Firm* — Venable LLP

(57) ABSTRACT

An electrophotographic member has a base layer, an elastic layer, and a surface layer on the elastic layer, in this order in a thickness direction, wherein the surface layer includes a urethane resin, a perfluoropolyether compound including a specific repeating structure, and a polyol compound having a specific structure.

10 Claims, 3 Drawing Sheets

(56) References Cited

U.S. PATENT DOCUMENTS

| | | | | |
|---|---|---|---|---|
| 7,001,699 | B2 | 2/2006 | Tanaka et al. | |
| 7,045,261 | B2 | 5/2006 | Tanaka et al. | |
| 9,250,546 | B2 | 2/2016 | Kameyama | |
| 9,282,615 | B2 | 3/2016 | Yamagishi et al. | |
| 9,341,964 | B2 | 5/2016 | Ogaki et al. | |
| 9,423,727 | B2 | 8/2016 | Yoshida et al. | |
| 9,442,430 | B2 | 9/2016 | Hamana et al. | |
| 9,575,422 | B2 | 2/2017 | Okuda et al. | |
| 9,575,439 | B2 | 2/2017 | Tsuji | |
| 9,606,478 | B2 | 3/2017 | Tsuji | |
| 9,791,792 | B2 | 10/2017 | Miyauchi et al. | |
| 10,768,557 | B2 | 9/2020 | Okamoto et al. | |
| 2005/0208402 | A1 | 9/2005 | Tanaka et al. | |
| 2012/0049124 | A1* | 3/2012 | Wu | H01B 1/24 399/302 |
| 2012/0107559 | A1* | 5/2012 | Ferrar | G03G 15/162 399/302 |
| 2013/0149540 | A1 | 6/2013 | Sato | |
| 2019/0294089 | A1 | 9/2019 | Miyauchi | |
| 2019/0294090 | A1 | 9/2019 | Notoya | |
| 2020/0310302 | A1* | 10/2020 | Suzuki | G03G 5/14726 |
| 2020/0409294 | A1 | 12/2020 | Miyauchi | |
| 2021/0003953 | A1 | 1/2021 | Miyauchi | |

FOREIGN PATENT DOCUMENTS

| | | | |
|---|---|---|---|
| JP | 6324228 | B2 | 5/2018 |
| JP | 2020-118845 | A | 8/2020 |
| JP | 2020-160160 | A | 10/2020 |

* cited by examiner

ELECTROPHOTOGRAPHIC MEMBER AND ELECTROPHOTOGRAPHIC IMAGE FORMING APPARATUS

BACKGROUND

Field

The present disclosure relates to an electrophotographic member and electrophotographic image forming apparatus.

Description of the Related Art

Some image forming apparatuses adopting an electrophotographic system employ an intermediate transfer system that temporarily primarily transfers a toner image which has been formed on an image carrying member such as a photosensitive member onto an intermediate transfer member, and then secondarily transfers the resultant tonner image onto a recording medium such as a recording paper.

In order to realize a higher image quality of an electrophotographic image, also for the intermediate transfer member, such a structure has been adopted as to be capable of more efficiently performing secondary transfer onto the recording medium such as paper, even when a toner having a large specific surface area is used. Specifically, for example, in order to enhance followability of a toner image carrying surface (hereinafter, also referred to as an "outer surface") of the intermediate transfer member with respect to a thick paper or a recording medium having unevenness, an intermediate transfer member having an elastic layer (hereinafter, also referred to as an "elastic intermediate transfer member") is used. In the elastic intermediate transfer member, a deformation amount of the elastic layer is large, and a urethane resin is used that can satisfactorily follow the deformation of the elastic layer, also for the surface layer which covers the surface of the elastic layer (Japanese Patent Application Laid-Open No. 2015-125226).

Meanwhile, using a surface layer containing a perfluoropolyether compound (hereinafter, also referred to as "PFPE") in an acrylic resin is disclosed in order to reduce an adhesion of the toner to the outer surface of the intermediate transfer member (Japanese Patent No. 6324228).

The present inventors have studied incorporating PFPE into the surface layer of a transfer belt provided with an elastic layer according to Japanese Patent Application Laid-Open No. 2015-125226. However, it has been difficult to stably incorporate PFPE into the surface layer containing the urethane resin, and it has been difficult to impart stable toner releasability to the outer surface of the surface layer.

SUMMARY

At least one aspect of the present disclosure is directed to providing an electrophotographic member in which an outer surface of a surface layer containing a urethane resin, on an elastic layer, stably exhibits excellent toner releasability. In addition, another aspect of the present disclosure is directed to providing an electrophotographic image forming apparatus that can stably form a high-quality electrophotographic image.

According to one aspect of the present disclosure, there is provided an electrophotographic member that includes a base layer, an elastic layer, and a surface layer on the elastic layer, in this order in a thickness direction, wherein the surface layer includes: (a) a urethane resin; (b) a perfluoropolyether compound including at least one of repeating structures represented by structural formulae (1) to (4):

Structural formula (1)

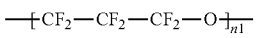

Structural formula (2)

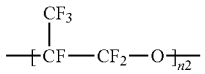

Structural formula (3)

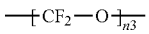

Structural formula (4)

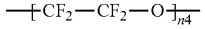

wherein in structural formulae (1) to (4), n1 to n4 each represent an integer of 1 or larger; and (c) a polyol compound represented by structural formula (5)

Structural formula (5)

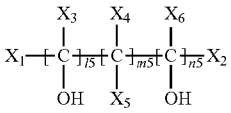

wherein X1 to X6 each independently represent an H atom or a C1 to C12 alkyl, alkenyl or alkynyl group having a straight-chain, branched or cyclic structure; and 15, m5 and n5 are each independently an integer of 0 or larger, and satisfy 15+n5≥2.

In addition, according to another aspect of the present disclosure, there is provided an electrophotographic image forming apparatus including the above electrophotographic member.

Further features of the present disclosure will become apparent from the following description of exemplary embodiments with reference to the attached drawings.

DESCRIPTION OF THE EMBODIMENTS

Preferred embodiments of the present disclosure will now be described in detail in accordance with the accompanying drawings.

In order to stably impart excellent toner releasability to the outer surface of the surface layer, it is effective that the surface layer includes PFPE uniformly in the thickness direction and continuously supplies PFPE to the outer surface, for example. However, in the case of a surface layer containing a urethane resin as a binder resin, hereinafter referred to as "urethane resin-containing surface layer", the present inventor found difficult to include PFPE uniformly in the urethane resin-containing surface layer in the thickness direction. Then, the present inventors have made extensive studies so as to include PFPE uniformly in the urethane resin-containing surface layer in the thickness direction. As a result, it has been found that it is effective to include a polyol having a specific structure, together with PFPE in the urethane resin-containing surface layer.

An electrophotographic member according to one aspect of the present disclosure will be described below, while taking an electrophotographic member having an endless belt shape (hereinafter, also referred to as "electrophotographic belt") as an example.

Figure 2A:
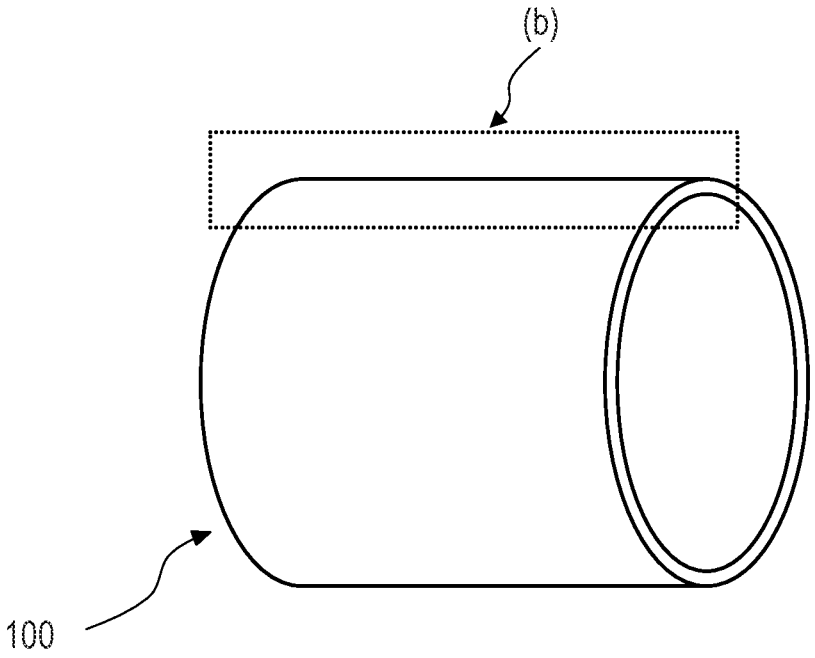
FIG. 2A illustrates a perspective view of an electrophotographic belt 100 according to one aspect of the present disclosure.
Figure 2B:
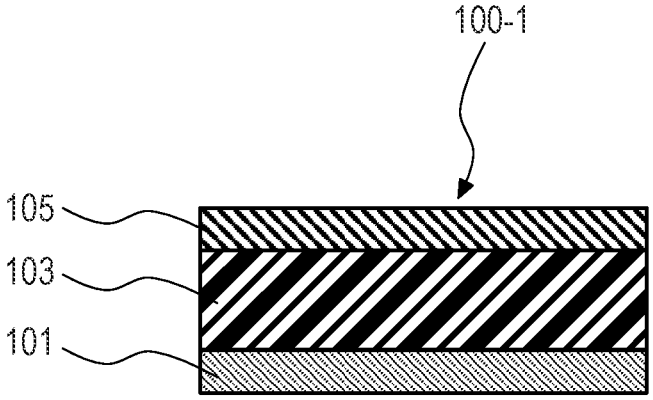
FIG. 2B illustrates a cross-sectional view of a portion (b) of the perspective view of FIG. 2A.

FIG. 2A is a perspective view of an electrophotographic belt 100 according to one aspect of the present disclosure, and FIG. 2B is a cross-sectional view of a portion (b) of FIG. 2A. The electrophotographic belt according to the present aspect includes a base layer 101, an elastic layer 103 on the base layer, and a surface layer 105 on the elastic layer. The surface of the surface layer 105 on a side opposite to a side facing the elastic layer 103 constitutes an outer surface 100-1 of the electrophotographic belt. When the electrophotographic belt according to the present aspect is used as an intermediate transfer belt, the outer surface 100-1 becomes a surface that carries a toner image thereon.

The surface layer 105 includes the following (a) to (c):

(a) a urethane resin;

(b) a perfluoropolyether compound that contains at least one of repeating structures represented by structural formulae (1) to (4):

Structural formula (1)

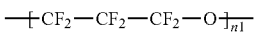

Structural formula (2)

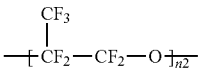

Structural formula (3)

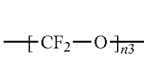

Structural formula (4)

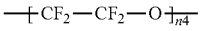

wherein in structural formulae (1) to (4), n1 to n4 each represent an integer of 1 or larger; and (c) a polyol compound represented by structural formula (5)

Structural formula (5)

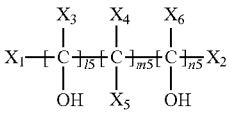

wherein X1 to X6 each independently represent an H atom or a C1 to C12 alkyl, alkenyl or alkynyl group having a straight-chain, branched or cyclic structure; and 15, m5 and n5 are each independently an integer of 0 or larger, and satisfy 15+n5≥2.

The surface layer 105 contains a urethane resin excellent in flexibility as a binder resin, and thereby can prevent occurrence of cracks even when the elastic layer has been deformed.

In addition, the surface layer 105 includes the PFPE that contains at least one of the repeating structures represented by the above structural formulae (1) to (4), and the polyol compound represented by the above structural formula (5); and thereby becomes capable of stably imparting excellent toner releasability to the outer surface 100-1.

The present inventors presume the reason why the outer surface 100-1 can stably exhibit the excellent toner releasability by including the above components (a) to (c) in the surface layer, as follows.

Figure 3:
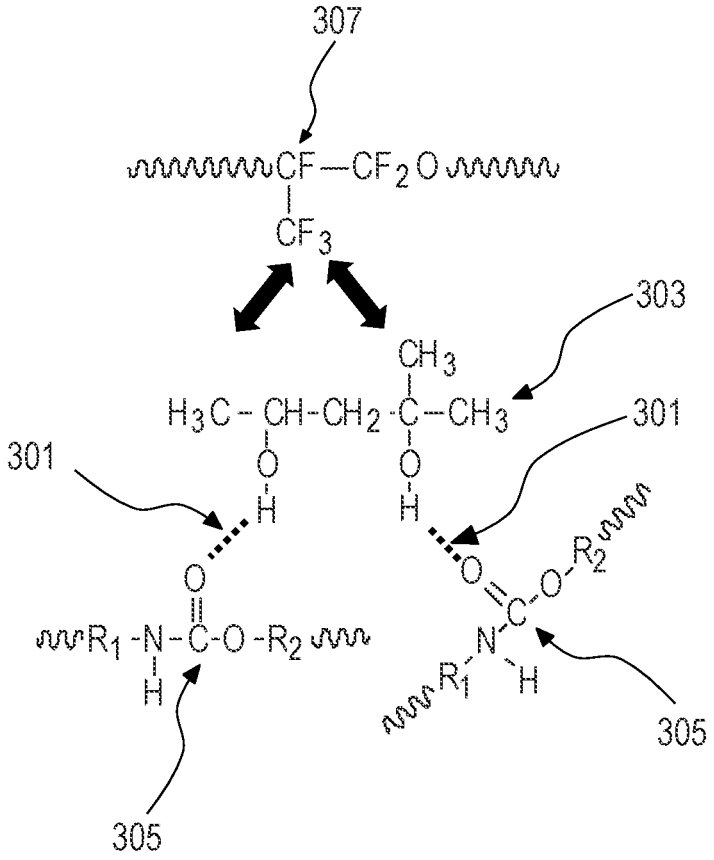
FIG. 3 illustrates a conceptual diagram describing a hydrogen bond between a polyol compound and a urethane compound.

Specifically, as illustrated in FIG. 3, a hydroxyl group of the polyol compound 303 forms a hydrogen bond 301 with a urethane bond which is a polar portion of the urethane resin 305, in the surface layer. On the other hand, the hydrocarbon portion of the polyol compound interacts with a perfluoropolyether compound (PFPE) 307 which has high hydrophobicity. In other words, the PFPE and the urethane resin interact with each other via the polyol compound, which can thereby suppress phase separation between the urethane resin and the PFPE in the surface layer. As a result, it is considered that it can include PFPE in the surface layer in the thickness direction, and cause PFPE to continually exist on the outer surface 100-1.

An embodiment of one aspect of the present disclosure will be described below in detail.

[Base Layer]

The base layer has a shape of a roll or a shape of a seamless type of cylindrical belt (also referred to as an endless belt shape), and a material thereof is not particularly limited as long as the material is excellent in heat resistance and mechanical strength.

In the case of the roll shape, materials to be used include: metals such as aluminum, iron, copper and nickel; alloys such as stainless steel and brass; and ceramics such as alumina and silicon carbide.

Examples of materials of the base layer suitable for the belt-shaped member include, in addition to the materials, resin materials such as polyethylene terephthalate, polybutylene naphthalate, polyester, polyimide, polyamide, polyamide-imide, polyacetal and polyphenylene sulfide.

The base layer preferably has electroconductivity, and preferably contains an electroconductive agent. The electroconductive agent may include an ion conductive agent and an electron conductive agent.

An electroconductive powder such as a metallic powder, an electroconductive oxide powder or electroconductive carbon may be added as the electroconductive agent in order to preliminarily impart electroconductivity.

In the present disclosure, a polyimide film to which carbon black is added is particularly preferable from viewpoints of the mechanical strength and the electroconductivity. The thickness of the base layer is preferably 10 μm or larger and 500 μm or smaller, more preferably 30 μm or larger and 150 μm or smaller.

[Elastic Layer]

The elastic layer is a layer having flexibility, and when the obtained electrophotographic member is used as an intermediate transfer member, the followability to a recording medium at the time of transfer is improved due to having the elastic layer. Because of this, toner can be easily transferred also onto a recording medium having unevenness.

The material constituting the elastic layer is preferably a rubber material. Examples thereof include natural rubber, styrene-butadiene rubber, butadiene rubber, isoprene rubber, nitrile rubber, chloroprene rubber, butyl rubber and ethylene-propylene rubber. In addition, other examples of the rubber material include chlorosulfonated rubber, acrylate rubber, epichlorohydrin rubber, urethane rubber, silicone rubber and fluororubber. Among the materials, silicone rubber is preferable from a viewpoint of being capable of exhibiting characteristics from low temperature to high temperature and a viewpoint of being excellent in ozone resistance.

The thickness of the elastic layer is preferably 100 μm or larger and 1000 μm or smaller, more preferably 200 μm or larger and 500 μm or smaller, from the viewpoint of sufficiently utilizing the flexibility. The thickness of the elastic layer can be represented by an average value of measured values at a plurality of positions.

The material constituting the elastic layer may contain an electroconductive agent such as an electron conductive agent or an ion conductive agent as needed. Examples of the electron conductive agent include electroconductive carbon black such as acetylene black and ketjen black, graphite, graphene, carbon fiber and carbon nanotube. In addition, examples thereof include: powders of metals such as silver, copper and nickel; electroconductive zinc oxide; electroconductive calcium carbonate; electroconductive titanium oxide; electroconductive tin oxide; and electroconductive mica. Among the materials, electroconductive carbon black is preferable from the viewpoint of easiness in controlling electric resistance. Examples of the ion conductive agent include liquids containing ions such as a lithium salt, a potassium salt and an ammonium salt. The amount of the electroconductive agent to be blended into the material constituting the elastic layer is preferably 35 parts by mass or less, more preferably 25 parts by mass or less per 100 parts by mass of the silicone rubber, from the viewpoint of mechanical strength. In addition, a lower limit of the amount of the electroconductive agent to be blended is not particularly limited, and may be any amount as long as electroconductivity can be imparted to the intermediate transfer member. Thereby, a stable electroconductivity suitable for the intermediate transfer member is imparted to the elastic layer.

In addition, the material constituting the elastic layer may contain other additives such as a filler, a crosslinking accelerator, a crosslinking retarder, a crosslinking aid, a scorch retarder, an antiaging agent, a softening agent, a heat stabilizer, a flame retardant, a flame retardant aid, an ultraviolet absorber and a rust-preventive agent. The fillers, in particular, include reinforcing fillers such as fumed silica, crystalline silica, wet silica, fumed titanium oxide and cellulose nanofiber. The reinforcing fillers include organoalkoxysilane, organohalosilane and organosilazane, from the viewpoint of being easily dispersed in silicone rubber. In addition, other examples of the reinforcing fillers may include a material that is surface-modified with an organosilicon compound such as a diorganosiloxane oligomer or a cyclic organosiloxane in which both terminals of the molecular chain are blocked with silanol groups.

[Surface Layer]

(Urethane Resin)

The surface layer includes a urethane resin as a binder resin. As for the urethane resin, it is easy to appropriately select the breaking strength and elastic modulus. Because of this, the urethane resin can be suitably used for the surface layer of the electrophotographic member having the elastic layer, which accordingly tends to easily cause cracks, as in the present disclosure.

The urethane resin has a polar urethane group, and can form a hydrogen bond with the polyol compound which is a feature of the present disclosure. It is considered that the interaction between the highly hydrophobic perfluoropolyether compound and the hydrophobic surface of the polyol compound is relatively enhanced in the surface layer, and as a result, the perfluoropolyether compound and the urethane resin can be combined.

The polyurethane resin in the present disclosure is not particularly limited as long as the polyurethane resin has a urethane group, but it is preferable to use a water-based polyurethane dispersion (hereinafter, referred to also as "PUD"), from the viewpoint of reducing an environmental load at the time of the application and reducing a damage to the elastic layer due to the use of an organic solvent.

Specific examples of the PUD include, but are not limited to, the following compounds. "Emralon 345", "Emralon T-861" and "Emralon T-820" (all are trade names, and are produced by Henkel Japan Ltd.). "DAOTANVTW1265/36WA" and "DAOTANTW6450/30WA" (both are trade names, and are produced by Daicel-Allnex Ltd.). "UW-5002E" and "UW-5034E" (both are trade names, and are produced by Ube Industries, Ltd.).

(Perfluoropolyether Compound (PFPE))

The PFPE has a structure having at least one of repeating structures that are represented by the following structural formulae (1) to (4):

Structural formula (1)

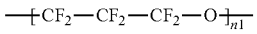

Structural formula (2)

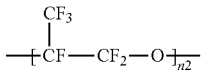

Structural formula (3)

Structural formula (4)

wherein in structural formulae (1) to (4), n1 to n4 each represent an integer of 1 or larger.

The order of existence of the repeating structures is not particularly limited, and the repeating structure may exist at a plurality of positions in PFPE. In other words, the PFPE that includes repeating structures may be a block copolymer, or a random copolymer.

The molecular terminal structure in a main chain of the PFPE is preferably a $CF_3$ group.

The content of the PFPE in the surface layer is preferably 1% by mass or more and 40% by mass or less, particularly preferably 5% by mass or more and 30% by mass or less, based on the total amount of the urethane resin, the PFPE and the polyol compound. When the content of the PFPE is within the above range, low adherability of the surface layer can be improved, and satisfactory toner transferability and crack resistance can be maintained even in long-term use.

The molecular weight of the PFPE is preferably 300 or more and 50,000 or less, particularly preferably 500 or more and 20,000 or less by a number average molecular weight, from a viewpoint of easily interacting with a hydrophobic surface of the polyol and a viewpoint of surface bleeding.

Specific examples of the PFPE are given below.

PFPE having a structure represented by structural formula (6) (for example, "Demnum S200" and "Demnum S100" (both are trade names, and are produced by Daikin Industries, Ltd.)):

Structural formula (6)

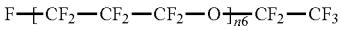

wherein in structural formulae (6), n6 represents an integer of 1 or larger.

PFPE having a structure represented by structural formula (7) (for example, "VPF16256", "Krytox GPL107" and "Krytox GPL106" (all are trade names, and are produced by Chemours. com)):

Structural formula (7)

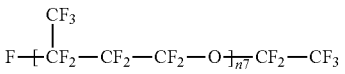

wherein in structural formulae (7), n7 represents an integer of 1 or larger.

PFPE represented by structural formula (8) (for example, "Fomblin M60" and "Fomblin M30" (both are trade names, and are produced by Solvay Japan, Ltd.)):

Structural formula (8)

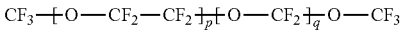

wherein in structural formulae (8), p and q each independently represent an integer of 1 or larger.

In addition, examples of the PFPE having a repeating structure of the above described structural formulae (3) and (4) and having a polar functional group at a molecular terminal having a straight-chain structure include: "D4000" (trade name and produced by Solvay Japan Ltd.) having hydroxyl groups at both terminals; "MD700" (trade name and produced by Solvay Japan Ltd.) having methacrylate groups at both terminals; and "ZDIAC4000" (trade name and produced by Solvay Japan Ltd.) having carboxylic acids at both terminals. Note that the PFPE may or may not have a polar functional group. However, PFPE that does not have a polar functional group has lower affinity with polyurethane than PFPE that has the polar functional group, and thus is inferior in dispersibility in polyurethane, in some cases. However, even such PFPE can be stably dispersed in polyurethane, with the use of the technology according to the present disclosure.

(Polyol Compound)

As described above, due to the existence of the polyol compound in the surface layer, the urethane resin and the perfluoropolyether compound can be combined without causing macroscopic separation.

The polyol compound has two or more hydroxyl groups. The reason for this is because a hydrophobic surface can be formed more effectively when hydrogen bonds are formed at multiple points. In addition, from the same viewpoint, the main chain structure of the polyol compound is preferably formed of a hydrocarbon, and preferably has at most one hydroxyl group on the same carbon atom.

The boiling point of the polyol compound is preferably 150° C. or higher, more preferably 180° C. or higher, from the viewpoint of the film-forming temperature of the electrophotographic member. For that purpose, the number of carbon atoms of the hydrocarbon constituting the main chains is preferably C2 or more.

The polyol compound in the present disclosure is represented by the following structural formula (5).

Structural formula (5)

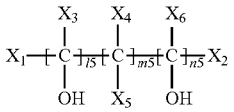

wherein X1 to X6 each independently represent an H atom or a C1 to C12 alkyl, alkenyl or alkynyl group having a straight-chain, branched or cyclic structure; and 15, m5 and n5 are each independently an integer of 0 or larger, and satisfy 15+n5≥2.

Specific examples of the polyol compound include ethylene glycol, propylene glycol, hexylene glycol and acetylenol.

The content of the polyol compound is preferably 0.3% by mass or more and 20% by mass or less, more preferably 0.5% by mass or more and 15% by mass or less, based on the total amount of the urethane resin, the perfluoropolyether and the polyol compound in the surface layer. With the content of the polyol compound being 0.3% by mass or more and 20% by mass or less, the combination effect is easily obtained and sedimentation in dispersion is less likely to occur.

Furthermore, the mass ratio of the PFPE to the polyol compound (PFPE/polyol compound) in the surface layer is preferably in a range of 1/2 to 32/1, for example. With the mass ratio within this range, the PFPE can be more uniformly dispersed in the polyurethane and the PFPE can be more stably transferred to the outer surface of the surface layer.

The thickness (film thickness) of the surface layer is preferably 1 μm or larger and 10 μm or smaller. With the film thickness within this range, abrasion is less likely to occur and an elastic function of the elastic layer can be obtained. Note that the thickness of the surface layer can be represented by an average value of measured values at a plurality of positions.

The material constituting the surface layer may contain an electroconductive agent such as an electron conductive agent or an ion conductive agent as needed. Examples of the electroconductive agent include the above described agents concerning the elastic layer. The amount of the electroconductive agent to be blended into the material constituting the surface layer is preferably 30 parts by mass or less per 100 parts by mass of the resin material that forms the surface layer, from viewpoints of adherability between the surface layer and another layer and the mechanical strength.

Note that the polyol compound in the present disclosure can be extracted from the surface layer, by using an appropriately selected solvent.

In addition, a primer layer may be provided between the elastic layer and the surface layer, as needed. The thickness of the primer layer is preferably 0.1 μm or larger and 10 μm or smaller, from the viewpoint of not hindering the elastic function.

[Electrophotographic Member]

Examples of the use of the electrophotographic member include a charging member, a developing member, a transfer member, an intermediate transfer member, a toner supply member, and a cleaning member; and the electrophotographic member is particularly preferably used as the intermediate transfer member.

The volume resistivity of the electrophotographic member is preferably $1.0\times10^{6}$ Ω·cm or higher and $1.0\times10^{14}$ Ω·cm or lower, and more preferably $1.0\times10^{8}$ Ω·cm or higher and $1.0\times10^{13}$ Ω·cm or lower. The surface resistivity that has been measured from the surface layer side is preferably $1.0\times10^{6}$ Ω/□ or higher and $1.0\times10^{14}$Ω/□ or lower, more preferably $1.0\times10^{9}$ Ω/□ or higher and $1.0\times10^{13}$Ω/□ or lower. With the electric resistance of the electrophotographic member within the range of the above semiconductive region, in the case where the electrophotographic member is used as the intermediate transfer member, an unfixed toner image which has been formed on the electrophotographic photosensitive member can be primarily transferred stably onto the intermediate transfer member. In addition, the toner image transferred onto the intermediate transfer member can also be secondarily transferred stably onto a recording medium.

In addition, the electrophotographic member according to the present disclosure preferably has an elastic modulus of 0.1 MPa or higher and 30 MPa or lower, which is measured on an outer surface of the surface layer by an indentation test by a nanoindentation method according to the ISO14577. With such an elastic modulus, the secondary transferability, onto the recording medium, of the toner image carried on the outer surface can be further improved.

Note that, as for the measurement conditions of the elastic modulus, a Vickers indenter was used as an indenter, the maximum load was 260 μN, and a load of 26 μN per second was increased for 10 seconds until the maximum load was reached. In addition, the holding time of the maximum load is set at 0 second (none), the load is removed at 26 μN per second for 10 seconds, and the measurement is completed within 20 seconds from the start of load application.

Measurement environment: temperature 25° C. and relative humidity 50%;

Maximum load: 260 μN;

Push-in speed: the load is applied in proportion to time at such a speed that the maximum load is reached in 10 seconds, and the load is removed in proportion to time at such a speed that the load reaches 0 in 10 seconds.

Maximum load holding time: none (0 second).

[Image Forming Apparatus]

An example of an image forming apparatus using the electrophotographic member as an intermediate transfer belt will be described with reference to FIG. 1. Note that the present disclosure is not limited to the following description.

Figure 1:
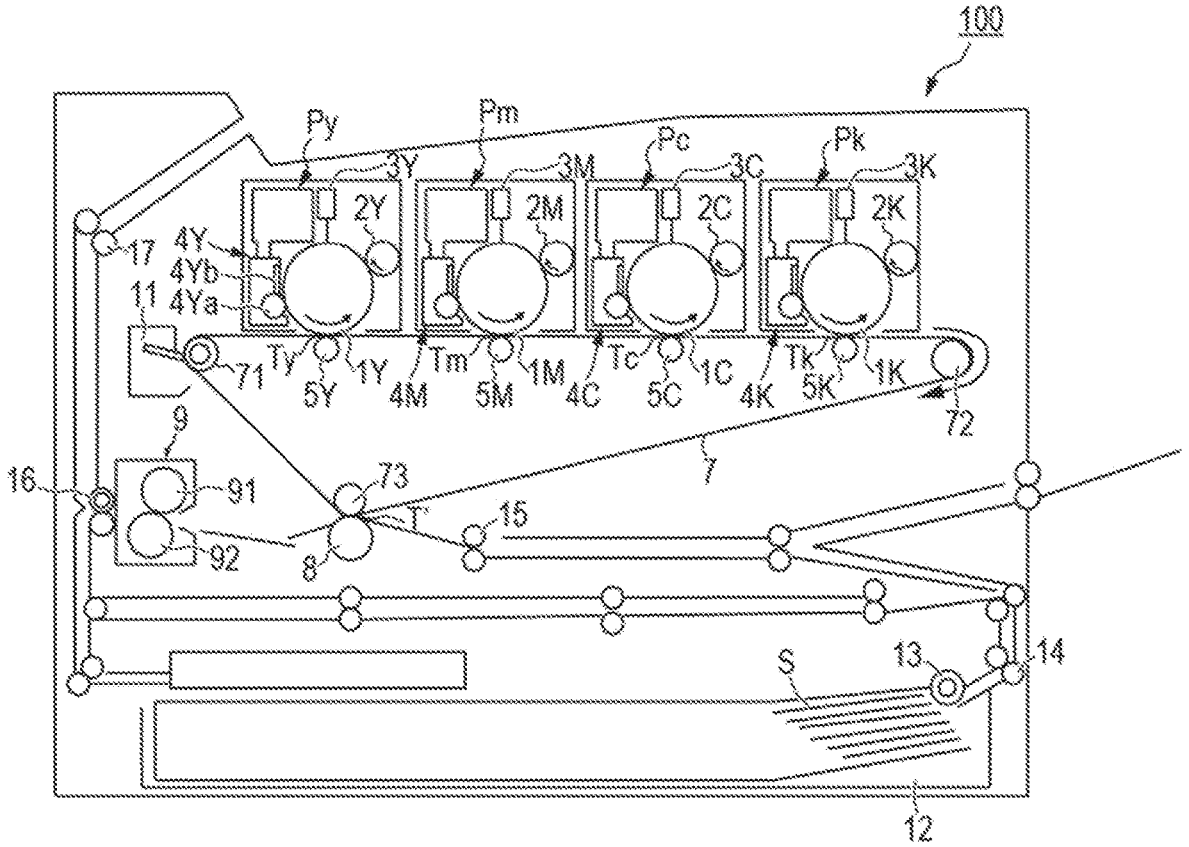
FIG. 1 illustrates a cross-sectional view illustrating one example of an electrophotographic image forming apparatus that uses an electrophotographic member according to one aspect of the present disclosure.

An electrophotographic image forming apparatus 100 in FIG. 1 is a color electrophotographic image forming apparatus (color laser printer). In the electrophotographic image forming apparatus 100, image forming units Py, Pm, Pc and Pk of respective colors of yellow (Y), magenta (M), cyan (C) and black (K) are arranged in this order in the moving direction, along a flat portion of the intermediate transfer belt 7 which is the intermediate transfer member. Here, 1Y, 1M, 1C and 1K each indicate the electrophotographic photosensitive member, 2Y, 2M, 2C and 2K each indicate a charging roller, 3Y, 3M, 3C and 3K each indicate a laser exposure apparatus, 4Y, 4M, 4C and 4K each indicate a developing apparatus, and 5Y, 5M, 5C and 5K each indicate a primary transfer roller. Each of the image forming units Py, Pm, Pc and Pk has the same basic structure, and accordingly, as for the detail of the image forming units, only a yellow image forming unit Py will be described.

The yellow image forming unit Py includes a drum type of electrophotographic photosensitive member (hereinafter, also referred to as "photosensitive drum" or "first image carrying member") 1Y as an image carrying member. The photosensitive drum 1Y is formed by using a cylinder made from aluminum as a substrate, and stacking an electric charge generation layer, an electric charge transfer layer and a surface-protecting layer in this order on the cylinder.

In addition, the yellow image forming unit Py includes the charging roller 2Y as a charging unit. Due to a charging bias being applied onto the charging roller 2Y, the surface of the photosensitive drum 1Y is uniformly charged.

The laser exposure apparatus 3Y as an image exposure unit is arranged above the photosensitive drum 1Y. The laser exposure apparatus 3Y scans and exposes the surface of the uniformly charged photosensitive drum 1Y according to image information, and forms an electrostatic latent image of a yellow color component on the surface of the photosensitive drum 1Y.

The electrostatic latent image that has been formed on the photosensitive drum 1Y is developed by the toner which is a developer, by the developing apparatus 4Y as a developing unit. Specifically, the developing apparatus 4Y includes a developing roller 4Ya which is a developer carrying member and a regulating blade 4Yb which is a developer amount regulating member, and accommodates a yellow toner which is the developer. The developing roller 4Ya to which the yellow toner has been supplied is lightly pressed against the photosensitive drum 1Y in a developing portion, and is rotated in a forward direction to the photosensitive drum 1Y with a speed difference. The yellow toner that has been conveyed to the developing portion by the developing roller 4Ya adheres to the electrostatic latent image which has been formed on the photosensitive drum 1Y, due to a developing bias being applied to the developing roller 4Ya. Thereby, a visible image (yellow toner image) is formed on the photosensitive drum 1Y.

The intermediate transfer belt 7 is stretched around a driving roller 71, a tension roller 72 and a driven roller 73, and is moved (rotationally driven) in a direction indicated by an arrow in the drawing, while being brought into contact with the photosensitive drum 1Y. The yellow toner image that has been formed on the photosensitive drum 1Y (on the first image carrying member) and has reached a primary transfer portion Ty is primarily transferred onto the intermediate transfer belt 7 by a primary transfer member (primary transfer roller 5Y) that is arranged so as to face the photosensitive drum 1Y via the intermediate transfer belt 7.

Similarly, the above image forming operation is performed in each of the image forming units Pm, Pc and Pk of magenta (M), cyan (C) and black (K) along with the movement of the intermediate transfer belt 7, and toner images of four colors of yellow, magenta, cyan and black are stacked on the intermediate transfer belt 7. A toner layer of four colors is conveyed according to the movement of the intermediate transfer belt 7, and in a secondary transfer portion T', is collectively transferred onto a transfer material S (hereinafter, also referred to as "second image carrying member") which is conveyed at a predetermined timing by a secondary transfer roller 8 as a secondary transfer unit. In such secondary transfer, a transfer voltage of several kV is usually applied in order to ensure a sufficient transfer rate, and at this time, discharge occurs in the vicinity of a transfer nip, in some cases. Note that this discharge causes a decrease in the surface characteristics of the intermediate transfer member, in some cases.

The transfer material S is supplied to a conveyance path from a cassette 12 in which the transfer material S is stored, by a pickup roller 13. The transfer material S that has been supplied to the conveyance path is synchronized with the toner images of the four colors, which have been transferred to the intermediate transfer belt 7 by a pair of conveyance rollers 14 and a pair of resistance rollers 15, and is conveyed to the secondary transfer portion T'.

The toner image that has been transferred onto the transfer material S is fixed by a fixing apparatus 9, and becomes an image of full color, for example. The fixing apparatus 9 includes a fixing roller 91 having a heating unit and a pressing roller 92, and fixes the unfixed toner image on the transfer material S by heating and pressing the unfixed image. After that, the transfer material S is discharged to the outside of the apparatus by a pair of conveyance rollers 16 a pair of discharge rollers 17, and the like.

A cleaning blade 11 which is a cleaning unit for the intermediate transfer belt 7 is arranged in a downstream of the secondary transfer portion T' in a driving direction of the intermediate transfer belt 7, and removes a transfer residual toner which has remained on the intermediate transfer belt 7 without being transferred to the transfer material S in the secondary transfer portion T'.

As described above, such a process is repeatedly performed as to electrically transfer the toner image from the photosensitive member 1 to the intermediate transfer belt 7, and from the intermediate transfer belt 7 to the transfer material S. In addition, when recording on a large number of transfer materials S is repeated, the electrical transfer process results in being further repeated. By using the electrophotographic member according to the present disclosure as the intermediate transfer belt 7 in the above electrophotographic image forming apparatus, the toner can be satisfactorily transferred at the time of the secondary transfer, and the transfer system can be realized which maintains a satisfactory image quality even in long-term use.

EXAMPLES

The present disclosure will be described below in detail with reference to Examples and Comparative Examples, but the present disclosure is not limited thereto.

Chemical compounds described in Tables 1-1 to 1-3 were used as a urethane resin, a perfluoropolyether compound, and a polyol compound according to Examples and Comparative Examples.

TABLE 1-1

(a) Urethane resin (water-based dispersion)

| Abbreviation | Product name |
|---|---|
| PUD-1 | "Emralon T-861" (Trade name, produced by Henkel Japan Ltd.; Solid component concentration: 30% by mass) |
| PUD-2 | "Emralon T-345" (Trade name, produced by Henkel Japan Ltd.) |

TABLE 1-2

(b) Perfluoropolyether compound

| Abbreviation | Product name |
|---|---|
| PFPE-1 | "Krytox GPL107" (Trade name, produced by The Chemours Company) |
| PFPE-2 | "Demnum S200" (Trade name, produced by Daikin Corporation) |
| PFPE-3 | "Fomblin M60" (Trade name, produced by Solvay Japan Ltd.) |
| PFPE-4 | "D4000" (Trade name, produced by Solvay Japan Ltd.; alcohol at both ends) |
| PFPE-5 | "MD700" (Trade name, produced by Solvay Japan Ltd.; methacrylate at both ends) |

TABLE 1-3

(c) Polyol compound

| Abbreviation | Product name |
|---|---|
| PO-1 | Hexylene glycol (boiling point of 198° C., produced by Tokyo Chemical Industry Co., Ltd.) |
| PO-2 | Ethylene glycol (boiling point of 198° C., produced by Tokyo Chemical Industry Co., Ltd.) |

TABLE 1-3-continued (c) Polyol compound

| Abbreviation | Product name |
|---|---|
| PO-3 | Acetylenol (Trade name "Surfynol 104"; produced by Shin-Etsu Chemical Co., Ltd., and boiling point > 200° C.) |

Example 1

(Formation of Substrate (Base Layer))

Electroconductive carbon black (trade name: Denka Black, produced by Denki Kagaku Kogyo Kabushiki Kaisha) was added to an N-methyl-2-pyrrolidone solution of polyamic acid (trade name: U Varnish A, produced by Ube Industries, Ltd.), which is a polyimide precursor. At this time, the electroconductive carbon black in an amount of 19% by mass based on the total mass of the polyamic acid and the electroconductive carbon black was added and mixed. The obtained mixed liquid was applied to an outer peripheral surface of a cylindrical support made from stainless steel (SUS304) having an outer diameter of 330 mm and a length of 300 mm, the surface of which was subjected to blast treatment. Next, the resultant cylindrical support was heated in a heating furnace at a temperature of 220° C. for 30 minutes, and then was heated at a temperature of 350° C. for 30 minutes to polymerize the polyimide precursor that was applied to the outer peripheral surface of the cylindrical support, and a polyimide film was formed. After cooling, the polyimide film was removed from the cylindrical support, and an endless belt-shaped substrate was obtained which had a thickness of 70 μm. The outer peripheral surface of the substrate was subjected to excimer UV irradiation and hydrophilic treatment, and then was coated with a primer liquid (trade name: SILASTIC DY39-067; produced by Dow Chemical Japan Ltd.).

(Formation of Elastic Layer)

Potassium-bis(trifluoromethanesulfonyl)imide (trade name: EF-N112; produced by Mitsubishi Materials Electronic Chemicals Co., Ltd.), which is an ion conductive agent, in an amount of 0.2 parts by mass was added to and mixed with 100 parts by mass of an addition curing type liquid silicone rubber (trade name: TSE3450A/B; produced by Momentive Performance Materials LLC). Next, the resultant was stirred and defoamed by a planetary stirring defoaming apparatus (trade name: HM-500; produced by Keyence Corporation), and a coating liquid for an elastic layer was prepared. Subsequently, the substrate prepared above was attached to a cylindrical core, and a ring nozzle for discharging rubber was attached coaxially with the core. The coating liquid for the elastic layer was supplied to the ring nozzle with the use of a liquid feeding pump, and was discharged from a slit, and thereby, the coating liquid for the elastic layer was applied onto the substrate. At this time, a relative movement speed and the discharge amount of the liquid feeding pump were adjusted so that a thickness of the silicone rubber layer after having been cured became 280 μm, and a coating film was formed. The resultant substrate was placed in a heating furnace, in a state of being attached to the core, and was heated at 130° C. for 15 minutes and further at 180° C. for 60 minutes; and the coating film was cured. After cooling, the belt was removed from the core, and the belt was obtained on which the elastic layer was stacked.

(Formation of Surface Layer)

PO-1 as a polyol compound and PFPE-1 as a perfluoropolyether compound were added in an amount of 5 parts by mass and 20 parts by mass, respectively, were added to pure water. The liquid was stirred and defoamed by the planetary stirring defoaming apparatus (trade name: HM-500, manufactured by Keyence Corporation), and an aqueous emulsion liquid of a perfluoropolyether compound was prepared. The obtained aqueous emulsion liquid in an amount of 30 parts by mass was added to 100 parts by mass of the polyurethane dispersion liquid (PUD-1), and the mixed liquid was stirred and defoamed by the planetary stirring defoaming apparatus; and a coating liquid for a surface layer was prepared. The surface of the elastic layer of the belt obtained above was subjected to hydrophilic treatment by excimer UV irradiation, and the resultant belt was fitted to a core. The coating liquid for the surface layer was applied to the resultant belt with the use of a spray gun (trade name: W-101; manufactured by Anest Iwata Corporation) while the belt was rotated at 200 rpm. After coating, the belt was placed in a heating furnace, and was heated at a temperature of 130° C. for 30 minutes. The resultant belt was cooled to room temperature (temperature: 25° C.), and an intermediate transfer belt was obtained on which the surface layer was formed. The obtained intermediate transfer belt was subjected to the following evaluations 1 to 3.

[Evaluation 1: Hexadecane Contact Angle]

The intermediate transfer belt was mounted on an electrophotographic image forming apparatus (trade name: image RUNNER ADVANCE C5051; manufactured by Canon Inc.). Then, a contact angle (hereinafter, also referred to as "contact angle 1") of the outer surface of the intermediate transfer belt, and a contact angle (hereinafter, also referred to as "contact angle 2") of the outer surface of the intermediate transfer belt were measured respectively after 10 sheets of A4 size rough paper (trade name: Business 4200, produced by Xerox Corporation, 102 μm thick, and basis weight: 75 g/m$^2$) were continuously passed through the electrophotographic image forming apparatus, and again at the time when the rough paper was subsequently continuously passed therethrough and reached 100,000 sheets. Note that, in the measurement of the contact angle, the volume of hexadecane that was dripped on the outer surface was 2.0 μl. In addition, for the measurement, a contact angle meter (trade name: DM-501, manufactured by Kyowa Interface Science Co., Ltd.) was used, and a value was employed which was measured after 1.0 second after dripping of hexadecane onto the outer surface.

[Evaluation 2: Toner Transferability]

The intermediate transfer belt was mounted on the electrophotographic image forming apparatus (trade name: image RUNNER ADVANCE C5051; manufactured by Canon Inc.). In addition, as for a toner to be used for image formation, a cyan toner for the above electrophotographic image forming apparatus was classified, and was adjusted so that an average grain size became 4.8 μm. With the use of the cyan toner adjusted in this way, a solid image of the cyan was formed on A4 size rough paper (trade name: Business 4200, produced by Xerox Corporation, 102 μm thick, and basis weight: 75 g/m$^2$). The solid image was formed in a high-temperature and high-humidity environment at a temperature of 30° C. and a relative humidity of 80%. Then, the solid image of the 10th sheet and the solid image of the 100,000th sheet were visually observed, and were evaluated according to the following criteria.

[Evaluation Criteria]

Rank A: there is almost no image unevenness.

Rank B: slight image unevenness occurs in some parts.

Rank C: transfer is insufficient and white spots occur in some parts.

Rank D: transfer is insufficient and white spots occur on the entire surface.

[Evaluation 3: Crack Resistance]

After the completion of Evaluation 2, the intermediate transfer belt was removed from the electrophotographic image forming apparatus, and the outer surface of the intermediate transfer belt was observed with an optical microscope (trade name: VHX-600; manufactured by Keyence Corporation); and the presence or absence of a crack and the number of occurrences thereof were determined, and were evaluated according to the following criteria.

[Evaluation Criteria]

Rank A: no cracks occur.

Rank B: some cracks occur.

Rank C: cracks occur on the entire surface.

Examples 2 to 12

An intermediate transfer belt according to each example was produced in the same manner as the intermediate transfer belt according to Example 1, except that the urethane resin, the perfluoropolyether compound, the polyol compound and the blended amount which were used for producing the surface layer were changed as illustrated in Table 2. These intermediate transfer belts were subjected to Evaluation 1, Evaluation 2, and Evaluation 3.

TABLE 2

| | Urethane resin | Perfluoropolyether compound | | Polyol compound | |
|---|---|---|---|---|---|
| | Material type | Material type | Content (wt %) | Material type | Content (wt %) |
| Example 1 | PUD-1 | PFPE-1 | 16 | PO-1 | 4 |
| Example 2 | PUD-1 | PFPE-2 | 16 | PO-1 | 4 |
| Example 3 | PUD-1 | PFPE-3 | 16 | PO-1 | 4 |
| Example 4 | PUD-1 | PFPE-4 | 16 | PO-1 | 4 |
| Example 5 | PUD-1 | PFPE-5 | 16 | PO-1 | 4 |
| Example 6 | PUD-1 | PFPE-1 | 16 | PO-2 | 4 |
| Example 7 | PUD-1 | PFPE-1 | 16 | PO-3 | 4 |
| Example 8 | PUD-1 | PFPE-1 | 16 | PO-1 | 0.5 |
| Example 9 | PUD-1 | PFPE-1 | 16 | PO-1 | 15 |
| Example 10 | PUD-1 | PFPE-1 | 2 | PO-1 | 4 |
| Example 11 | PUD-1 | PFPE-1 | 39 | PO-1 | 4 |
| Example 12 | PUD-2 | PFPE-1 | 16 | PO-1 | 4 |

Comparative Example 1

An intermediate transfer belt was produced in the same manner as in Example 1 except that the perfluoropolyether compound and the polyol compound were not used, in Example 1, and was subjected to Evaluation 1 to Evaluation 3.

Comparative Example 2

An intermediate transfer belt was produced in the same manner as in Example 1 except that the polyol compound was not used, in Example 1, and was subjected to Evaluation 1 to Evaluation 3.

Comparative Example 3

An intermediate transfer belt was produced in the same manner as in Example 4 except that the polyol compound was not used, in Example 4, and was subjected to Evaluation 1 to Evaluation 3.

Comparative Example 4

An intermediate transfer belt was produced in the same manner as in Example 1 except that the perfluoropolyether compound was not used, in Example 1, and was subjected to Evaluation 1 to Evaluation 3.

Comparative Example 5

An intermediate transfer belt was produced in the same manner as in Example 1 except that 4-methyl-pentanol (4MPO) which is a monool compound was used instead of the polyol compound, in Example 1, and was subjected to Evaluation 1 to Evaluation 3.

Comparative Example 6

A coating liquid for the surface layer was prepared which had a formula described in the following Table 3.

TABLE 3

| Material | Blended amount |
|---|---|
| Dipentaerythritol hexaacrylate | 10 parts by mass |
| Pentaerythritol tetraacrylate | 20 parts by mass |
| Initiator "Irgacure 184" (trade name; produced by BASF) | 2 parts by mass |
| PFPE-1 | 6.4 parts by mass |
| PO-1 | 1.6 parts by mass |
| Methyl ethyl ketone | 45 parts by mass |

An intermediate transfer belt was produced in the same manner as in Example 1 except that the surface layer was formed with the use of the above coating liquid for the surface layer, and was subjected to Evaluation 1 to Evaluation 3.

The formulae of the surface layers of the intermediate transfer belts according to Comparative Examples 1 to 6 are summarized in Table 4.

TABLE 4

| | Urethane | PFPE | | Polyol compound | |
|---|---|---|---|---|---|
| | resin Material type | Material type | Content [wt %] | Material type | Content [wt %] |
| Comparative Example 1 | PUD-1 | — | — | — | — |
| Comparative Example 2 | PUD-1 | PFPE-1 | 16 | — | — |
| Comparative Example 3 | PUD-1 | PFPE-4 | 16 | — | — |
| Comparative Example 4 | PUD-1 | — | — | PO-1 | 4 |
| Comparative Example 5 | PUD-1 | PFPE-1 | 16 | 4MPO | 4 |
| Comparative Example 6 | (Acrylic resin) | PFPE-1 | 16 | PO-1 | 4 |

The evaluation results of Examples 1 to 12 and Comparative Examples 1 to 6 are illustrated in Table 5. Note that, in the intermediate transfer belt according to Comparative Example 6, the surface layer was cracked before the number of sheets on which images were formed reached 100,000 sheets, and accordingly, the measurement of the contact angle 2 in Evaluation 1 and the evaluation of the solid image of 100,000th sheets in Evaluation 2 were not performed. In addition, in Evaluation 3, the rank was determined to be C, because the crack occurred in the surface layer before the number of sheets on which images were formed reached 100,000 sheets.

TABLE 5

| | | Evaluation 1 | | Evaluation 2 Evaluation rank | | Evaluation 3 |
|---|---|---|---|---|---|---|
| | | Contact angle 1 [°] | Contact angle 2 [°] | 10th sheet | 100,000th sheet | Evaluation rank |
| Example | 1 | 71 | 70 | A | A | A |
| | 2 | 70 | 69 | A | A | A |
| | 3 | 70 | 68 | A | A | A |
| | 4 | 64 | 59 | A | B | A |
| | 5 | 62 | 54 | A | B | A |
| | 6 | 68 | 66 | A | A | A |
| | 7 | 67 | 64 | A | A | A |
| | 8 | 70 | 64 | A | A | A |
| | 9 | 65 | 59 | A | B | A |
| | 10 | 61 | 57 | A | B | A |
| | 11 | 71 | 69 | A | A | B |
| | 12 | 71 | 70 | A | A | A |
| Comparative Example | 1 | 35 | 29 | C | D | A |
| | 2 | 39 | 35 | C | C | A |
| | 3 | 40 | 36 | C | C | A |
| | 4 | 32 | 25 | C | D | A |
| | 5 | 48 | 39 | C | C | A |
| | 6 | 41 | — | C | — | C |

It has been found from Table 6 that, in the case where the polyol compound does not exist, separated PFPE disappears by paper passing. It has been found that the intermediate transfer belt according to the present aspect has excellent toner transferability and crack resistance, and as a result, can form a high-quality electrophotographic image.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2020-153863, filed Sep. 14, 2020, and Japanese Patent Application No. 2021-134602, filed Aug. 20, 2021, which are hereby incorporated by reference herein in their entirety.

What is claimed is:

1. An electrophotographic member comprising:

a base layer;

an elastic layer; and a surface layer on the elastic layer, in this order in a thickness direction, wherein the surface layer comprises:

(a) a urethane resin;

(b) a perfluoropolyether compound including at least one of repeating structures represented by structural formulae (1) to (4):

Structural formula (1)

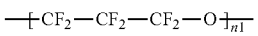

Structural formula (2)

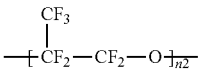

Structural formula (3)

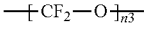

Structural formula (4)

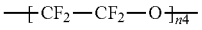

wherein in structural formulae (1) to (4), n1 to n4 each represent an integer of 1 or larger; and (c) a polyol compound represented by structural formula (5)

Structural formula (5)

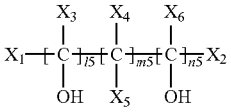

wherein X1 to X6 each independently represent an H atom or a C1 to C12 alkyl, alkenyl or alkynyl group having a straight-chain, branched or cyclic structure; and 15, m5 and n5 are each independently an integer of 0 or larger, and satisfy 15+n5≥2.

2. The electrophotographic member according to claim 1, wherein the polyol compound has a boiling point of 180° C. or higher.

3. The electrophotographic member according to claim 1, wherein the perfluoropolyether compound has a main chain having $CF_3$ group at a terminal end thereof.

4. The electrophotographic member according to claim 1, wherein a content of the perfluoropolyether compound is 1% by mass or more and 40% by mass or less based on a total amount of the urethane resin, the perfluoropolyether compound and the polyol compound.

5. The electrophotographic member according to claim 1, wherein a content of the polyol compound is 0.3% by mass or more and 20% by mass or less based on a total amount of the urethane resin, the perfluoropolyether compound and the polyol compound.

6. The electrophotographic member according to claim 1, wherein a mass ratio of the perfluoropolyether compound to the polyol compound (the perfluoropolyether compound/the polyol compound) in the surface layer is 1/2 to 32/1.

7. The electrophotographic member according to claim 1, having an endless belt shape.

8. The electrophotographic member according to claim 1, wherein the surface layer has a thickness of 1 to 10 μm.

9. An electrophotographic image forming apparatus comprising an electrophotographic member, wherein the electrophotographic member comprises:

a base layer; an elastic layer; and a surface layer on the elastic layer, in this order in a thickness direction, wherein the surface layer comprises: (a) a urethane resin;

(b) a perfluoropolyether compound including at least one of repeating structures represented by structural formulae (1) to (4):

Structural formula (1)

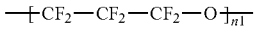

Structural formula (2)

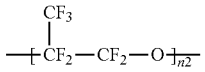

Structural formula (3)

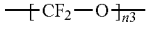

Structural formula (4)

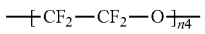

wherein in structural formulae (1) to (4), n1 to n4 each represent an integer of 1 or larger; and (c) a polyol compound represented by structural formula (5)

Structural formula (5)

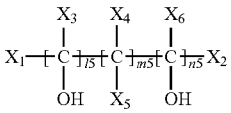

wherein X1 to X6 each independently represent an H atom or a C1 to C12 alkyl, alkenyl or alkynyl group having a straight-chain, branched or cyclic structure; and 15, m5 and n5 are each independently an integer of 0 or larger, and satisfy 15+n5≥2.

10. The electrophotographic image forming apparatus according to claim 9, comprising:

an electrophotographic photosensitive member;

an intermediate transfer member onto which an unfixed toner image that has been formed on the electrophotographic photosensitive member is primarily transferred; and a secondary transfer unit that secondarily transfers, onto a recording medium, the toner image transferred onto the intermediate transfer member, wherein the intermediate transfer member is the electrophotographic member.

* * * * *